United States Patent [19]

Chester

[11] 4,416,413

[45] Nov. 22, 1983

[54] POST OFFICE LOCKER

[75] Inventor: Richard J. Chester, Kennedy, N.Y.

[73] Assignee: American Locker Security Systems, Inc., Jamestown, N.Y.

[21] Appl. No.: 315,635

[22] Filed: Oct. 28, 1981

[51] Int. Cl.[3] ..... B65D 91/00; E05B 65/06; E05B 11/00

[52] U.S. Cl. ..... 232/24; 70/139; 70/389; 312/211; 312/215

[58] Field of Search ..... 232/24, 25, 27, 43.4; 312/109, 211, 215; 70/137, 139, 389

[56] References Cited

U.S. PATENT DOCUMENTS

| | | | |
|---|---|---|---|
| 693,770 | 2/1902 | Wright et al. | 232/24 |
| 753,302 | 3/1904 | Ogle | 232/24 |
| 973,920 | 10/1910 | Diehl | 70/389 |
| 1,735,379 | 12/1929 | Content | 312/211 X |
| 2,563,094 | 8/1950 | Becker . | |
| 3,193,074 | 7/1961 | Stackhouse | 194/92 |
| 3,599,770 | 8/1971 | Stackhouse et al. | 194/92 |
| 3,754,422 | 8/1973 | Stackhouse | 70/364 R |
| 3,790,244 | 2/1974 | Stackhouse | 312/215 |

FOREIGN PATENT DOCUMENTS

| | | | |
|---|---|---|---|
| 1221918 | 7/1966 | Fed. Rep. of Germany | 70/137 |
| 2833865 | 2/1980 | Fed. Rep. of Germany | 70/139 |

*Primary Examiner*—Robert P. Swiatek
*Attorney, Agent, or Firm*—Bean, Kauffman & Bean

[57] ABSTRACT

A post office locker for use in the delivery of both letters and packages to tenants of a multiple tenant building or the like, wherein packages are stored in appropriately sized storage cabinets to which access may be gained by intended recipients by use of access keys placed by a mailman in the letter boxes of such recipients. Each cabinet is fitted with a latch mechanism permitting recipients to return doors of cabinets from which packages have been removed to locked condition in a manner providing for the "capture" of the access keys until removed by a mailman for subsequent use. Preferably, the doors are fitted with return mechanisms providing for locking of such doors automatically upon return thereof into closed condition.

10 Claims, 10 Drawing Figures

Fig. 1.
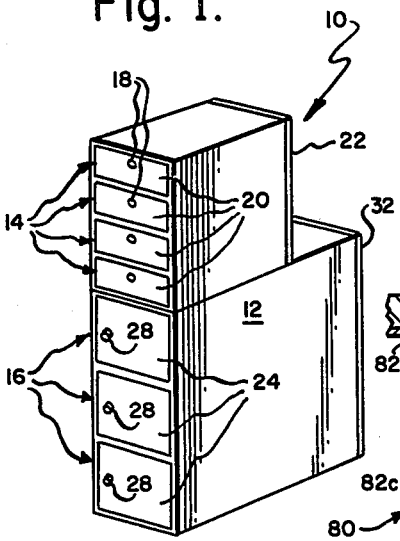
Fig. 3.
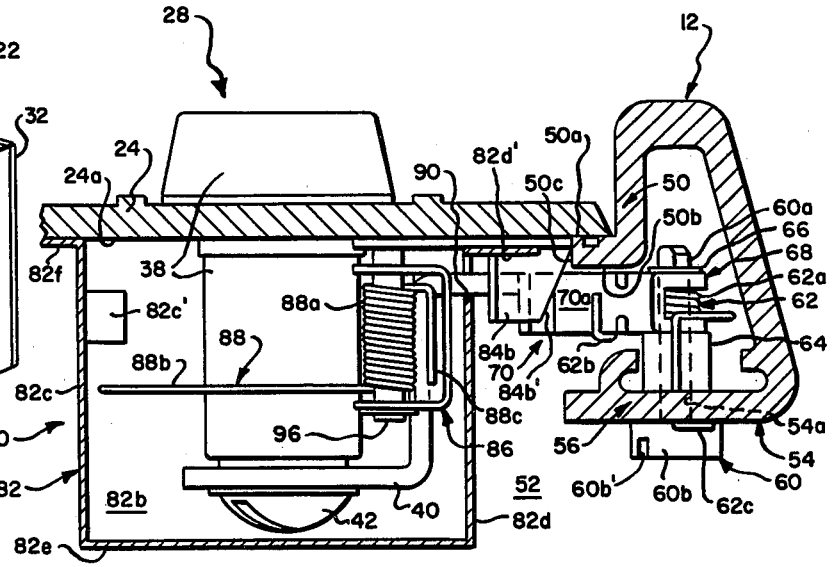
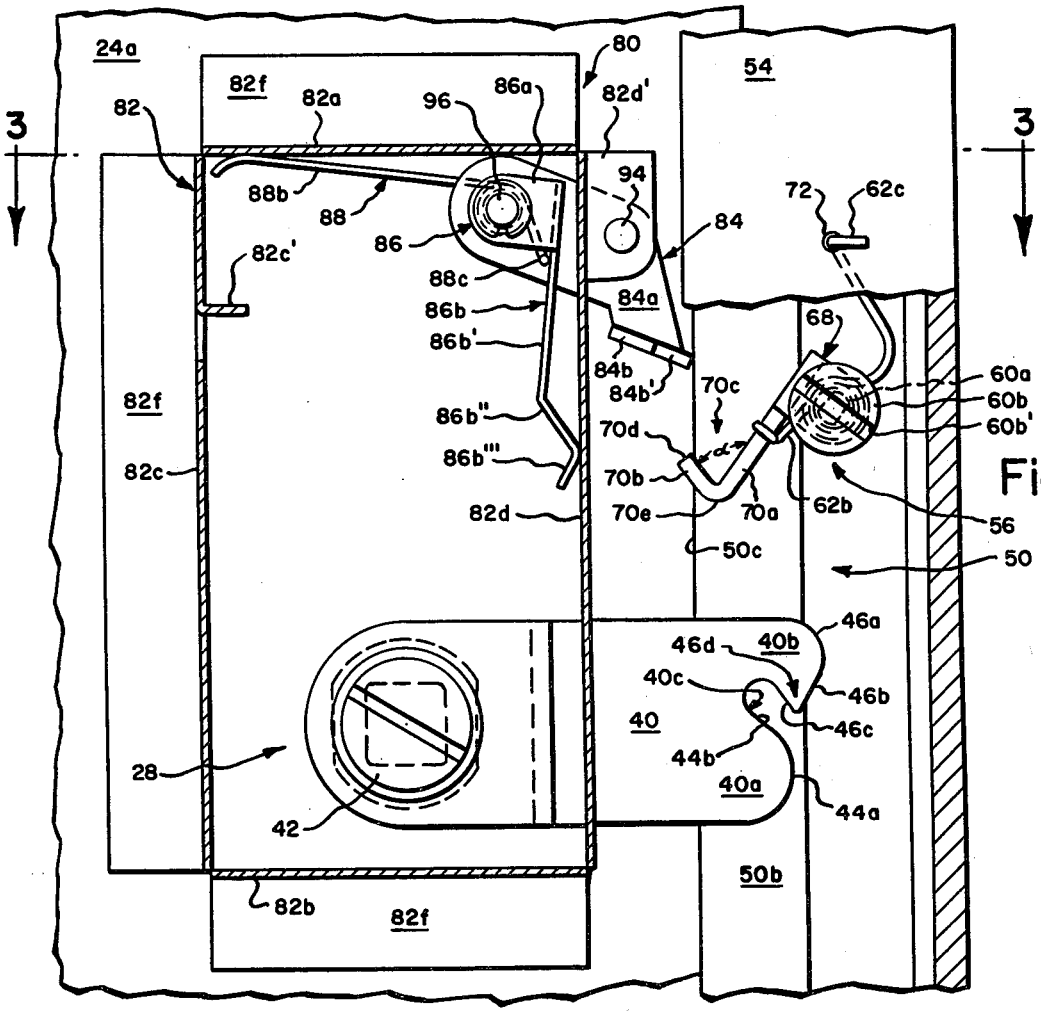
Fig. 2.

Fig. 5.
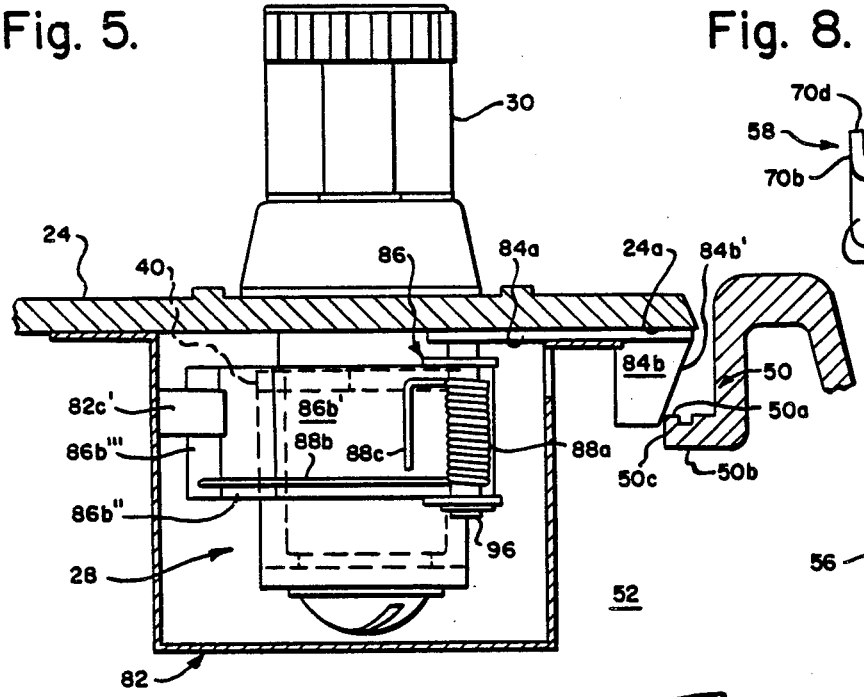
Fig. 8.
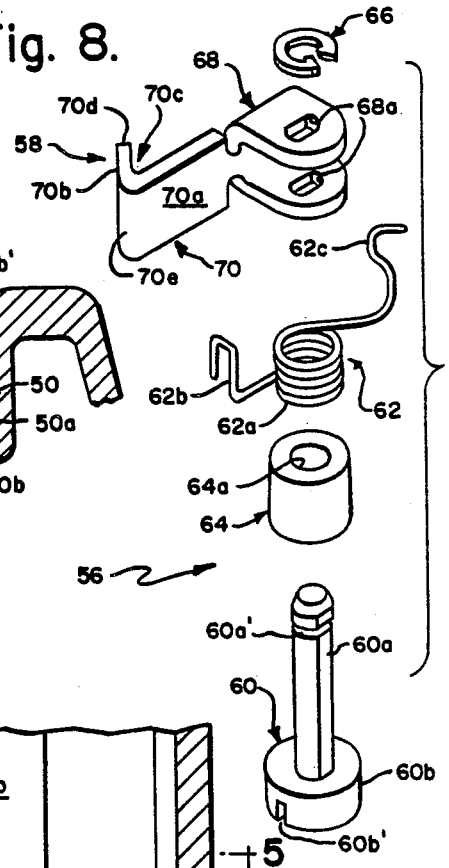
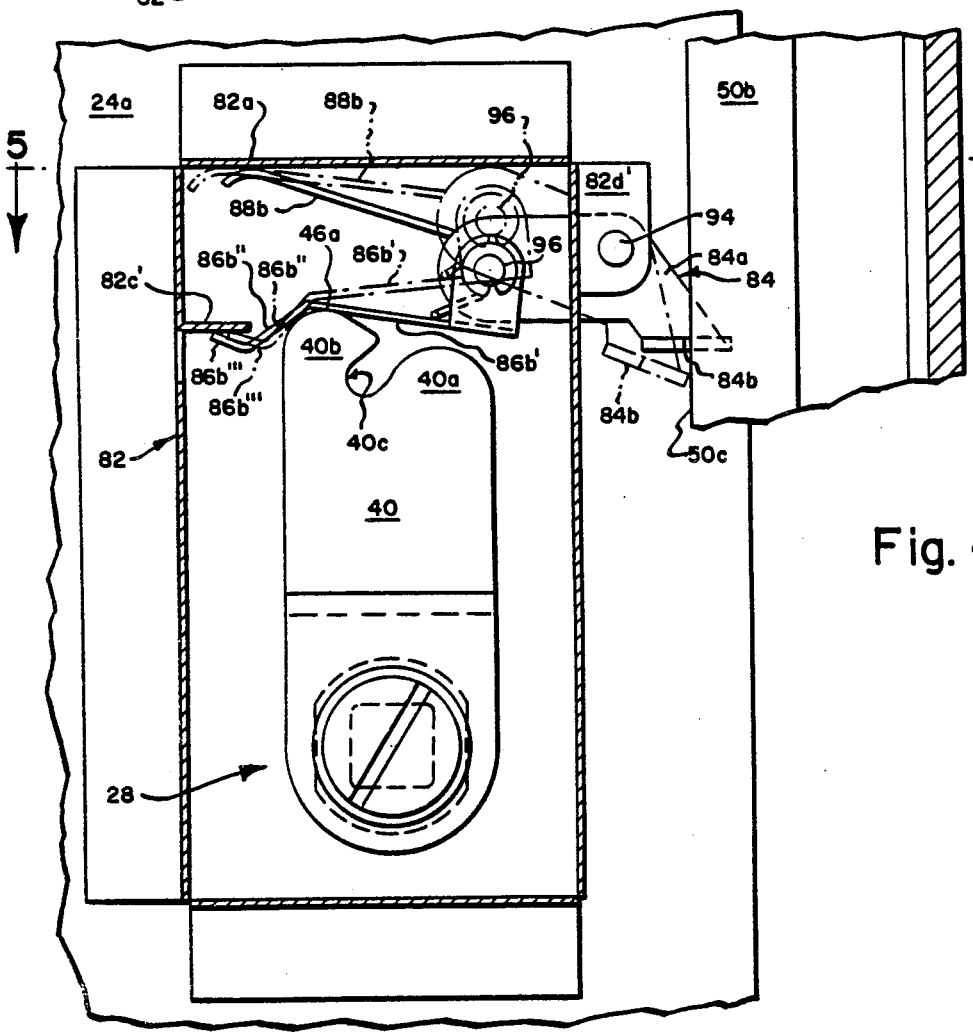
Fig. 4.

Fig. 6.
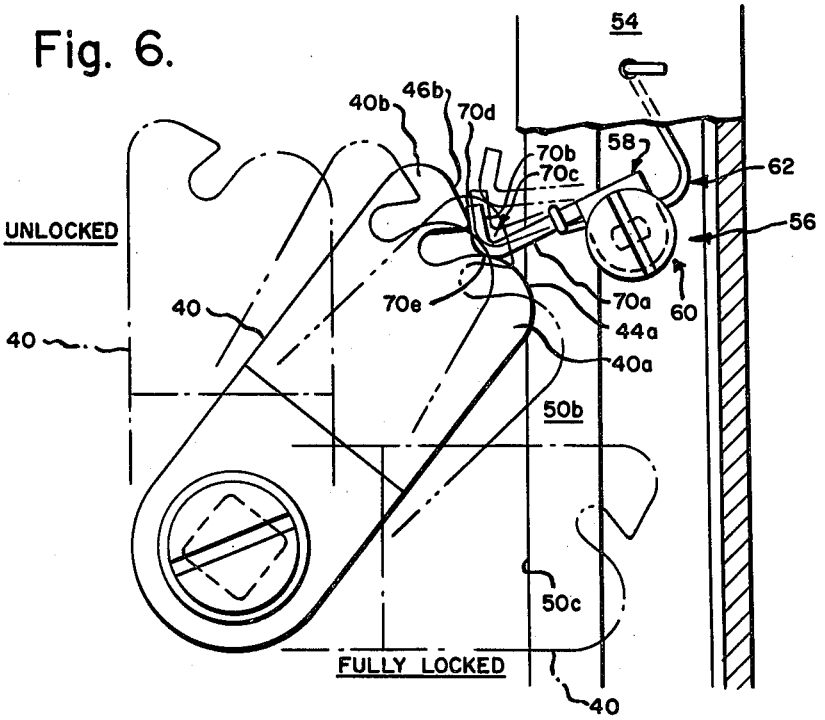
Fig. 7.
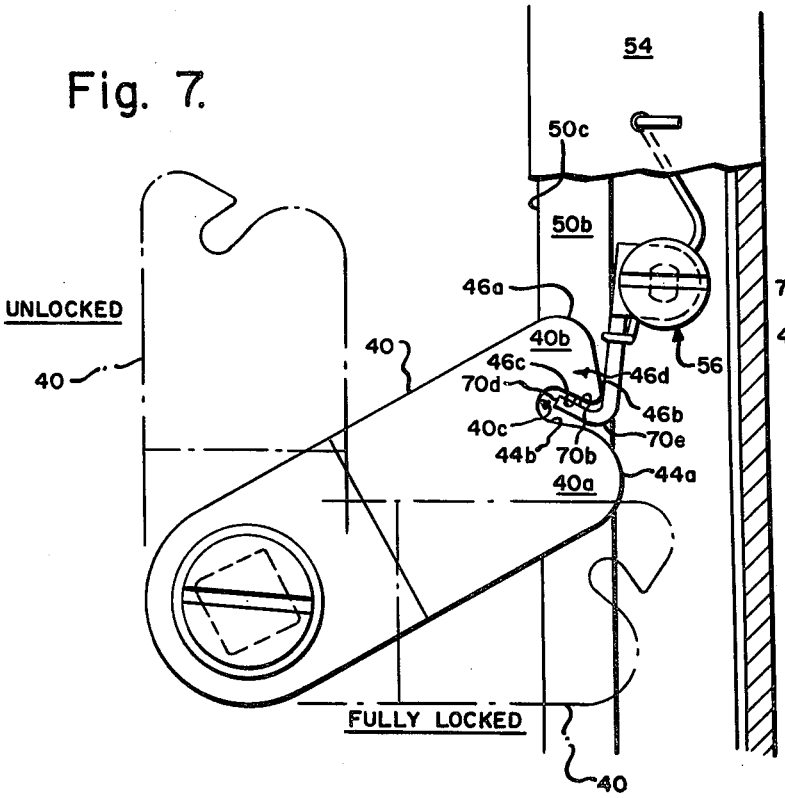
Fig. 7A.
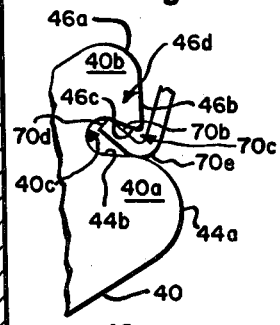
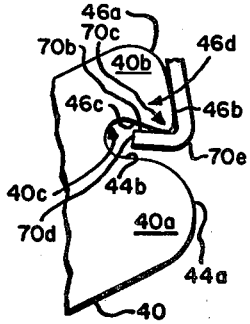
Fig. 7B.

POST OFFICE LOCKER

BACKGROUND OF THE INVENTION

The delivery of a package mailed to a tenant of a multiple tenant building, such as an apartment house or office building, or to a person receiving mail at a centralized pick up point in a rural community, such as may be located for use by tenants of a trailer park, has been a time consuming procedure both for the mailman charged with its delivery and for the intended recipient. In this respect, letter boxes normally provided for tenants of a multiple tenant building or trailer park are not of a size sufficient to receive medium to large size packages, and thus it has been necessary for the mailman to carry such packages directly to the door of the intended recipient. In the absence of the recipient, it is necessary for the mailman to return the package to the Post Office to await its personal pickup by the recipient.

A solution to the foregoing problem is offered by a mailbox unit of the type described in U.S. Pat. No. 3,790,244. In this patented unit, a plurality of large sized package storage cabinets are provided in proximity to a plurality of conventionally sized, key controlled letter boxes permanently assigned one to each tenant. The door of each storage cabinet is provided with a pair of key operated locks, namely, a custodian lock, which is operable by a key continuously retained in the possession of the mailman, and an access or recipient lock, which is overcontrolled by the custodian lock for single-shot door opening operation by an access key placed in the temporary custody of an intended recipient of a package.

More specifically, when the mailman wishes to deliver a package, he places the package in one of the storage cabinets and then places its associated access key, which is appropriately numbered or otherwise marked in conformity with such cabinet, in the intended recipient's letter box. The presence of an access key in his letter box automatically advises the intended recipient that he has received a package and he then uses such key to open the door of the appropriate storage cabinet to gain access to his package. As the access key is turned to unlock the access lock in order to permit opening of the storage cabinet door, a latch device controlled by the custodian lock automatically locks the access lock in unlocked condition, with the result that its access key is "captured" or retained in the access lock. During a subsequent mail delivery, the mailman may reuse the now empty storage cabinet by placing another package therein and then employing his key to momentarily unlock the custodian lock in order to release the access lock for return to its cabinet door locked condition. The access key may then be removed and deposited in an appropriate letter box.

A drawback of the patented unit is that the door of a storage cabinet is permitted to remain in an unlocked condition for an undetermined period of time between operation of the access lock for package removal purposes and a subsequent mail delivery, when the mailman may again lock the cabinet door in closed condition. Allowing an unattended cabinet to remain in an unlocked condition is undesirable in that it exposes the door and inside of the cabinet to vandalism, and permits persons to deposit trash and other undersirable objects within the cabinet. A further drawback of the patented unit is that it requires fitting each storage cabinet with a separate key controlled custodian lock, which is required to be sequentially operated with the access lock each time the latter is returned to locked condition.

SUMMARY OF THE INVENTION

The present invention relates to a post office locker for use in the delivery of mail, including packages, to a central pick up point serving a plurality of family or business units. More particularly, the present invention is directed towards an improved post office locker, which permits the recipient of a package to return a door of a storage cabinet from which such package has been withdrawn to a locked condition, whereafter the access key initially used by the recipient to gain access to the storage cabinet is "captured" or retained until subsequent removal by a mailman.

In a preferred form of the invention, a door of a storage cabinet from which a package has been removed is automatically locked incident to return movement of the door into its normally closed condition. In an alternative form of the invention, a recipient of a package may lock the door after it has been returned to closed condition by utilization of the access key.

DRAWINGS

The nature and mode of operation of the above invention will now be more fully described in the following detailed description taken with the accompanying drawings wherein:

FIG. 1 is a perspective view illustrating one type of post office locker unit having letter boxes and storage cabinets with which the present invention may be utilized;

FIG. 2 is a partial rear elevational view showing a door of one of the storage cabinets in a closed and fully locked condition;

FIG. 3 is a sectional view taken along the line 3—3 in FIG. 2;

FIG. 4 is a view similar to FIG. 2, but with the door in a closed and unlocked condition;

FIG. 5 is a sectional view taken generally along line 5—5 in FIG. 4, but showing the door in a partially open condition;

FIG. 6 is a view illustrating relative positions of a door mounted lock bolt and a locker cabinet frame mounted locking lever incident to pivotal movements of the lock bolt from door fully locked into door unlocked positions;

FIG. 7 is a view illustrating an intermediate locked position of the lock bolt;

FIGS. 7A and 7B are fragmentary views illustrating the range of travel of the lock bolt while in its intermediate locked position; and FIG. 8 is an exploded perspective view of the locker frame mounted latching mechanism.

DETAILED DESCRIPTION

Reference is now made more particularly to FIG. 1, wherein a post office locker unit incorporating the present invention is generally designated as 10. Unit 10 is shown as including a framework 12 housing a plurality of letter boxes 14 to be assigned to individual tenants of a building or other family or business units using a common mail pick up point, and at least one and preferably a plurality of package storage cabinets 16; the letter boxes being stacked on the storage cabinets in the manner shown in FIG. 1 or otherwise located in convenient proximity thereto. The number of letter boxes 14 and storage cabinets 16 provided for any given unit will of course vary depending upon the postal requirements of the building or mail pick up point at which the unit is to be installed.

As by way of example, each tenant of a multiple tenant building, that is, the leasee or owner of each apartment or office, would be assigned one of letter boxes 14 and a corresponding tenant key, not shown, for the purpose of operating a lock 18 carried by hingedly mounted letter box from door 20. Preferably, a mailman would be afforded simultaneous access to the rear of all letter boxes 14 for the purpose of depositing mail therewithin, by a removable mounted rear panel 22, which is normally locked in closed position by a key operated lock, not shown, operable only by the mailman. Alternatively, letter box locks 18 and/or the lock for panel 22 may be combination locks.

Storage cabinets 16, which may vary in size to provide convenient storage for variously sized packages, would each include a front door 24, which is hingedly mounted to framework 12 and carries an access or recipient lock 28 operated by an access key 30 shown only in FIG. 5. It will be understood that a different access key is required to operate the access lock of each storage cabinet and that each access key bears indicia, such as a numeral, letter, color or the like, which corresponds to indicia provided on the storage cabinet having its associated access lock.

Preferably, a mailman would be afforded simultaneous access to the rear of all of cabinets 16 for the purpose of depositing packages therewithin by means of a removable mounted rear panel 32 controlled by a key or other suitably operated lock, not shown, operable only by the mailman. If desired, panels 22 and 32 may be formed as a single panel.

The provision of removable panels 22 and 32 permits unit 10 to be mounted to extend through a building wall in order to expose the rear of the unit including panels 22 and 32 to a mail sorting room to which only the mailman has access and to expose the front of the unit including doors 20 and 24 to a lobby or entrance hall of a building to which the tenants have access. If desired, however, unit 10 may be left free standing within the building lobby or mounted on casters to permit it to be moved to the lobby from a mail sorting room.

Access locks 28 are preferably conventional cylinder locks of the type disclosed for example in U.S. Pat. Nos. 3,193,074; 3,599,770 and 3,754,422 for use as patron or custodian locks in coin operated locker cabinets. The disclosures of each of these patents is specifically incorporated by reference therein. Lock constructions of this type typically include a housing 38, which is non-rotatably fixed within a door aperture, not shown; a lock cylinder, not shown, which is rotatably supported within housing 38 and normally locked against rotation relative thereto by a suitable tumbler mechanism, not shown, adapted to be released upon insertion of appropriate access key 30 thereinto; and a lock bolt 40, which is fixed to the rear or inner end of the lock cylinder by a fastener 42 for rotation under the control of access key 30 between door fully locked and unlocked positions shown in full line in FIGS. 2 and 4, respectively. It is important to note that, since each access lock 28 is a conventional cylinder lock, access key 30 may be inserted into or removed from its associated lock cylinder only when the latter and lock bolt 40 are in fully locked position, shown in FIG. 2; the access key at all other rotatable positions of the lock cylinder and lock bolt being automatically "captured" or retained within the lock by the tumbler mechanism. As thus far described, unit 10 is similar to that described in U.S. Pat. No. 3,790,244, whose disclosure is also specifically incorporated by reference herein.

Access locks 28 employed in the practice of the present invention differ from prior conventional locks of the type described above in that the free swinging ends of their lock bolts 40 are provided with a pair of ears or cam members **40*a* and 40*b* separated by a latching recess 40*c*, which is inclined relative to a line drawn lengthwise of the lock bolt. More specifically, ear 40*a* is defined by a convex, arcuate cam surface 44*a* blended into a concave, clearance surface 44*b* bounding one side of recess 40*c*; and ear 40*b* is defined by a convex, arcuate cam surface 46*a*, which is disposed radially outwardly of surface 44*a* and is blended into a relatively straight cam surface 46*b* connected in turn to a relatively straight latch surface 46*c* bounding an opposite side of recess 40*c* and cooperating with cam surface 46*b* to define a generally V-shaped latch element 46*d*, which in turn substantially overlies recess 40*c*. Ear 40*b*** is considered to lead in the direction of swinging movement of the lock bolt towards its unlocked position.

Reference is now made to FIGS. 2 and 3, wherein frame 12 is shown as including in part a front flange portion 50 having an outwardly facing surface **50*a*, which defines a stop against which the rear surface 24*a* of door 24 abuts to define a door closed condition; an inwardly facing surface 50*b*, which defines a stop or latch surface releasably engageable by lock bolt 40 for purposes of retaining door 24 in closed condition; and a connecting edge surface 50*c*, which serves to bound one vertically extending side of an access opening affording access to the interior 52 of a storage cabinet 16 when its associated door 24 is unlocked and moved into an open condition. As shown in FIG. 3, front flange portion 50 may be formed as an integral part of a frame extrusion, which additionally includes a rear flange portion 54 accessible from within storage cabinet interior 52. In the illustrated construction, rear flange portion 54 serves as a convenient support for a lock bolt latching mechanism 56** employed in the practice of both forms of the present invention to be hereinafter described. It will be understood, however, that the present invention is not limited to the utilization of a frame extrusion of the design illustrated in the drawings, nor to the illustrated lapped door-frame type locker installation, wherein lapping edges of the cabinet doors engage with a portion of the locker frame to define a door closed condition. In this respect, it is contemplated that the invention may also be employed in association with flush mounted door type locker installations of the type illustrated for instance in U.S. Pat. No. 3,790,244, wherein locking bolts are adapted to be inserted within slot openings defined by the locker frame.

A first or basic form of the present invention may be practiced by providing a locker unit of the type described with the lock bolt latching mechanism 56 best shown in FIGS. 2, 3 and 8. Mechanism 56 generally comprises a locking lever 58; a bearing pin 60 for supporting the locking lever for pivotal movements relative to frame rear flange portion 54; a spring 62 for biasing the locking lever to normally assume a rest position thereof shown in FIG. 2; a sleeve-like bearing/-spacer 64; and means, such as split ring or spring clip 66, for maintaining mechanism 56 in assembled condition on rear flange portion 54. Locking lever 58 includes a U-shaped mounting or base end portion 68 having a pair of mounting openings 68*a* and 68*a* and a generally L-shaped latch end portion 70, which is defined by an intermediate flange 70*a* having one end joined to mounting end portion 68 and a latch flange 70*b* arranged to upstand from an opposite end of flange 70*a* at an angle "α" preferably equal to or slightly less than 90°, such that flanges 70*a* and 70*b* cooperate to define a latching recess 70*c* for receiving latch element 46*d*. Latch flange 70*b* may be considered as having a lip or free end portion 70*d* and a heel or connecting end portion 70*e* at its juncture with flange 70*a*.

Again referring to FIG. 8, it will be understood that bearing pin 60 is formed with a shank end portion 60*a* having a recess 60*a'* adjacent its free end for receiving split ring 66; and an integrally formed enlarged head end portion 60*b* having suitable means, such as a screw driver blade receiving slot 60*b'* or associated lever mechanism, not shown, for permitting a mailman to effect controlled rotations of the bearing pin and thus locking lever 58 relative to rear flange portion 54 for the reason to be described. It will also be understood that spring 62 is formed with a coiled central portion 62*a* to the opposite ends of which are connected end portions 62*b* and 62*c* adapted to operably engage with intermediate flange 70*a* and a mounting opening 72 formed in rear flange portion 54, respectively. As will be apparent, mechanism 56 is assembled in operative condition on rear flange portion 54 by inserting shank end portion 60*a* forwardly and successively through a bore or bearing opening 54*a* formed in the rear flange portion; a bore or bearing opening 64*a* formed in bearing/spacer 64; a first of mounting openings 68*a*; coil 62*a* of spring 62, while such coil is aligned with the pair of mounting openings 68*a*, 68*a* and spring end portion 62*b* is arranged to receive and overlie the opposite surfaces of intermediate flange 70*a*; and the second of mounting openings 68*a*. Split ring 66 is then fitted within recess 60*a'*, and finally spring end portion 62*c* is inserted rearwardly through mounting opening 72. Any suitable means may be employed to provide for relative rotational movement of locking lever 58 and pin 60 relative to rear flange portion 54 and bearing/spacer 64, while keying the locking lever and pin for conjunctive rotational movement. As by way of example, shank end portion 60*a* and mounting openings 68*a*, 68*a* may be provided with "double-D" configuration, similar to that typically employed to prevent rotation of lock housing 38 with its door mounting aperture.

When mechanism 56 is mounted on rear flange portion 54 in the manner described above, spring 62 tends to maintain locking lever 58 in a rest position shon in FIG. 2.

Operation of the first or basic form of the present invention will now be described with particular reference to FIGS. 2, 6 and 7. It wll be first understood, that the presence of an access key 30 in a letter box 14 serves to automatically advise an intended recipient of a package that such package has been stored in a given one of the locked storage cabinets 16 to which the recipient may gain access by use of such access key. Access to the package would then be gained by inserting access key 30 within the access lock 28 of the appropriate cabinet and then using the access key to rotate lock bolt 40 between its door fully locked position shown in FIG. 2 and its door unlocked position shown in FIG. 4; a pull exerted on the access key, which is "captured" in the access lock for all positions thereof other than its door fully locked position, being employed to swing door 24 to open position for package removal purposes after placement of lock bolt 40 in its door unlocked position.

It will be noted that pivotal unlocking movement of lock bolt 40 between the extreme broken line positions thereof shown in FIG. 6, which correspond to the fully locked and unlocked positions depicted in FIGS. 2 and 4, serves to bring ears 40*b* and 40*a* successively into engagement with locking lever 58 and effect pivotal deflections thereof against the return bias of spring 62. Further, it will be noted that, during an intermediate portion of its pivotal movement towards unlocked position, lock bolt 40 reaches the position shown in full line in FIG. 6, wherein both of ears 40*a* and 40*b* are brought into engagement with locking lever 58. When lock bolt 40 reaches this full line position, it can no longer be returned or rotated in a clockwise sense to its fully locked position, until completion of a door unlocking-/locking operational cycle, due to simultaneous engagement of opposite end portions 70*d* and 70*e* of latch flange 70*b* with cam surfaces 46*b* and 44*a*, respectively. However, counterclockwise directed pivotal movements of lock bolt 40 into its door unlocked position may be continued, since latch flange 70*b* is free to ride over cam surface 44*a*. In accordance with this form of the invention any suitable stop or abutment associated with door 24 may be employed to prevent oppositely directed pivotal movements of lock bolt 40 beyond its fully locked and unlocked positions.

In accordance with the practice of the present invention, a recipient of a package would be given suitable notice, such as might be displayed on the front of door 24 and/or attached to access key 30 advising that he is personally responsible for the access key temporarily placed in his possession, until such time as door 24 is returned to closed position and locked. Preferably, such notice would be accompanied by instructions, which require the recipient to return door 24 to its closed position immediately after a package has been removed and then to rotate access key 30 in an opposite or door locking direction, as may be clearly indicated by suitable arrows, not shown. Such instructions are required in practicing the first form of the present invention in that no means is provided to prevent the recipient or some other party from manipulating access key 30, while door 24 is in an open condition, for the purpose of returning lock bolt 40 to its fully locked position and thereby permit unauthorized removal of the access key from lock 28 and prevent subsequent closure of door 24, until such time as the lock is changed by fitting same with a replacement lock cylinder and access key.

After the recipient has returned door 24 to its closed condition and initiated rotation of access key 30 in its door locking direction, i.e. clockwise as viewed in FIGS. 4 and 7, the following sequence of events will occur to provide for "capturing" of lock bolt 40 in an intermediate return or door locked position in which door 24 is locked and access key 30 remains "captured" within lock 28. By now making reference specifically to FIG. 7, it will be understood that, as lock bolt 40 is rotated clockwise from its unlocked position, ear 40*a* is first brought into engagement with latch flange 70*b*, such that locking lever 58 is pivoted counterclockwise away from its normal position against the return bias of spring 62, as lip 70*d* of the latch flange slides along cam surface 44*a* relatively towards recess 40*c*. As clockwise directed movement of lock bolt 40 continues, lip 70*d* rides off of cam surface 44*a* with the result that the bias of spring 62 is permitted to pivot latch flange 70*a* in a clockwise direction towards its normal rest position for receipt within recess 40*c*, whereby to "capture" or retain lock bolt 40 in its intermediate door locked position shown in full line in FIG. 7. Continued clockwise movement of lock bolt 40 towards its fully locked position substantially beyond its intermediate door locked position is prevented by the seating of latch element 46*d* within latching recess 70*c*. Conversely, counterclockwise directed movement of lock bolt 40 towards its unlocked position substantially beyond its intermediate door locked position is prevented by simultaneous abutting engagement of latch surface 46*c* and cam surface 44*a* with lip 70*d* and heel 70*e* of latch flange 70*b*, respectively. The allowed limits of clockwise and counterclockwise directed movement of lock bolt 40, while in its intermediate door locked position, are shown in FIGS. 7B and 7A, respectively.

When lock bolt 40 is placed in its intermediate door locked position, shown in full line in FIG. 7, it has been rotated sufficiently towards its fully locked condition to place same in overlying engagement with frame surface 50*b* for door locking purposes, but not sufficiently to place lock 28 in a condition in which access key 30 may be removed. As a result, door 24 will remain in locked condition and access key 30 will remain "captured" within lock 28 until lock bolt 40 is "freed" from engagement with locking lever 58. In accordance with the present invention, access to latching mechanism 56 for purposes of "freeing" lock bolt 40 may be afforded a mailman by any suitable means, such as by removal of rear panel 32 to expose head and portion 60*b* for manual manipulation by a screw driver or like tool inserted within slot 60*b*'. More specifically, a mailman would manipulate head end portion 60*b* to effect a counterclockwise directed rotation of latching lever 58 against the bias of spring 62 by an amount sufficient to remove latch flange 70*b* from within recess 40*c* and then manually rotate lock bolt 40 into its fully locked position; the latching lever 58 automatically returning to its normal rest position under the bias of spring 62 as soon as the mailman releases head end portion 60*b*. A door unlocking/locking cycle is completed when the mailman removes access key 30 from lock 28 for subsequent deposit in one of letter boxes 14.

A second and preferred form the present invention provides an improvement over the basic form described above in that it provides a return mechanism 80, which serves to automatically rotate lock bolt 40 from door unlocked position into intermediate door locked position, as an incident to movement of door 24 into its closed position. Mechanism 80 is shown in FIGS. 2–5 as including a box-like housing 82 and a return assembly including a link 84, a pawl 86 and a spring 88 operably coupled to housing 82. Housing 82 includes top, bottom, opposite side and rear walls 82*a*–82*e*, respectively, and mounting flanges 82*f* for use in fixing the housing to door rear surface 24*a* with the rear end of access lock 28 arranged or enclosed therewithin. A substantial portion of the front vertically extending edge of side wall 82*d* is spaced rearwardly of door rear surface 24*a* to provide a vertical slot 90, shown only in FIGS. 3 and 5, for receiving link 84 and permitting rotation of lock bolt 40 between its fully locked position in which it projects from the housing and its unlocked position in which it is fully enclosed within the housing. Side wall 82*d* is also provided with a transversely, outwardly projecting mounting tab 82*d*', which borders an upper end of slot 90 and is also spaced from door rear wall 24*a*. Opposite side wall 82*c* is punched to define an inturned stop tab 82*c*'.

Again referring to FIGS. 2–5, it will be seen that link 84 includes a mounting flange 84*a*, which has a central portion pivotally coupled to mounting tab 82*d*' by a first pivot pin 94, one end portion pivotally coupled to pawl 86 by a second pivot pin 96 and an opposite end portion fixed to an upstanding operator or cam flange 84*b* formed with a rearwardly and inwardly inclined cam edge 84*b*'. The axes of pivot pins 94 and 96 are parallel to each other and the axis about which lock bolt 40 swings between its fully locked and unlocked positions. Pawl 86 includes a U-shaped mounting end portion 86*a*, which is provided with a pair of aligned apertures, not shown, for receiving second pivot pin 96 and a latch end portion 86*b* defined by first, second and third flanges 86*b*', 86*b*'' and 86*b*'''. Spring 88 includes a central coiled portion 88*a*, which is disposed concentrically of second pivot pin 96 within U-shaped mounting end portion 86*a*, and opposite end portions 88*b* and 88*c*, which are arranged to engage with a suitable stop, such as housing top wall 82*a*, and pawl latch end portion 86*b*, respectively.

By now referring to FIGS. 2 and 3, it will be understood that link 84 has its outer end aligned for abutting engagement with frame edge surface 50*c*, such that when door 24 is disposed in closed condition, link 84 is forced to assume a first position shown in full line in FIG. 2 and broken line in FIG. 4. In such first position of link 84, spring 88 tends to bias pawl 86 into a first pivotal position thereof, wherein pawl latch end portion 86*b* is disposed in abutting engagement with a suitable stop, such as the inner surface of housing side wall 82*d*, as shown in FIG. 2. Thus, FIGS. 2 and 3 depict the condition and relative placement of the elements of the return assembly, when door 24 is closed and lock bolt 40 is disposed in its fully locked position.

When a recipient seeks to gain access to a package by insertion of access key 30 into an appropriate access lock 28 and subsequent manual rotation of the access key for purposes of pivoting lock bolt 40 from its fully locked position shown in FIG. 2 towards its unlocked position shown in FIG. 4, the lock bolt is brought into engagement with pawl latch end portion 86*b*. As a result, pawl latch end portion 86*b* is caused to pivot about pin 96 against the bias of spring 88 from its first pivotal position into a second pivotal position thereof shown in broken line in FIG. 4, incident to placement of lock bolt 40 in its door unlocked position. When pawl 86 has been pivoted into its second pivotal position, its third flange 86*b*''' underengages tab 82*c*' or other suitable stop to limit further clockwise directed pivotal movements thereof, and lock bolt cam surface 46*a* is disposed in engagement with second flange 86*b*''.

During unlocking movments of lock bolt 40, link 84 remains in its first position, due to engagement thereof with frame edge surface 50*c*. Then, as the recipient opens door 24 to gain access to his package, as by exerting a pull on access key 30, link operating flange 84*b* rides off frame edge surface 50*c*, with the result that link 84 is pivoted about pivot pin 94 towards its second position shown in full line in FIG. 4 under the bias of spring 88. Incident to pivotal movement of link 84 towards its second position, pivot pin 96 is displaced downwardly and pawl 86 caused to undergo pivotal movement thereabout, until the pawl assumes its third pivotal position and link 84 assumes its second position, both of which are shown in full line in FIG. 4 and determined by engagement of third flange 86*b*''' with tab 82*c*' and by engagement of first and second flanges 86*b*' and 86*b*'' with opposite ends of lock bolt cam surface 46*a*. In the third pivotal position of pawl 86, lock bolt 40 is resiliently latched in a stable unlocked position, permitting a recipient to release access key 30.

As in the basic embodiment of the present invention, it is desirable to accompany notice of recipient responsibility for access key 30 with instructions to insure return of door 24 to its closed and locked condition. However, in accordance with this preferred form of the invention, such instructions need only require the recipient to return door 24 to its closed condition immediately upon removal of a package. In this connection, it will be understood by again making reference to FIGS. 4 and 5, that as door 24 is moved towards closed position, cam edge 84*b*' of link operator flange 84*b* is brought into sliding engagement with the rounded edge joining frame surfaces 50*a* and 50*c* with the result that link 84 is forced to pivot about pin 94 for return to its first position, as an incident to placement of the door in its fully closed position. It will also be understood that as an incident to pivotal movement of link 84 towards its first position, pivot pin 96 is progressively raised towards its broken line position shown in FIG. 4, such that first flange 86*b*' is removed from frictional engagement with lock bolt cam surface 46*a* and spring 88 acting through second flange 86*b*'' becomes effective to bias lock bolt 40 to undergo pivotal movement from its unlocked position towards its fully locked position. The relative arrangement of parts and degree of bias established in spring 88, during initial movement of lock bolt 40 into its unlocked position, is such that the lock bolt 40 will be pivoted with sufficient force to displace locking lever 58 in the manner described above and place the lock bolt in its intermediate door locked position. The completion of a door unlocking/locking operational cycle of a locker unit fitted with return mechanism 80 is identical to that previously described with reference to FIG. 7.

As when opening a conventional door by first rotating and then pulling on a door knob, it is necessary for a recipient to first rotate access key 30 sufficiently to place lock bolt 40 in its unlocked position and then pull on the access key for door opening purposes without at any time releasing the access key, until door 24 is placed in an open condition. Otherwise, spring 88 will be effective to drive lock bolt 40 towards its fully locked position, and if release of access key 30 should occur after lock bolt 40 has been rotated counterclockwise past its position shown in FIG. 6, the lock bolt will be driven into its intermediate locked position shown in FIG. 7 with the result that the recipient may not gain access to his package until the mailman completes the door operational cycle and again places the access key in the recipient's letter box.

While two forms of the present invention have been described, it is anticipated that further variations thereof will likely occur to those skilled in the art, as required to meet operating procedures established from time to time by postal authorities. As by way of example, it is contemplated that suitable means, such as a spring tensioned upon door opening movements, may be provided to automatically return a door to closed position upon release thereof by a recipient of a package or after a suitable time delay. Also, additional means may be provided for positively preventing accidental pivotal movements of the lock bolt from its unlocked position until after a cycle of door opening/closing movements has been completed. Further, with appropriate modifications of the structure of the cabinet door and locker frame, it would be possible to reverse the illustrated positions of the access lock and the lock bolt latching mechanism.

What is claimed is:

1. A post office locker permitting delivery and safe storage until pick up of both letters and packages to tenants of a multiple tenant building or the like, which comprises in combination:

a plurality of letter boxes assigned one to each of said tenants and accessible only to the tenant to which it is assigned and to a mailman charged with the delivery of mail to said building;

at least one package storage cabinet sized to receive packages too large to be accommodated within said letter boxes and accessible only to a given tenant to which a package is to be delivered and to said mailman, said cabinet having a door and an access lock movable between door fully locked and unlocked conditions for permitting opening of said door to afford access to said cabinet by means of an access key made available by said mailman to said given tenant by placement of said access key in the letter box of said given tenant, said access lock permitting said access key to be inserted into and/or removed therefrom only when said access lock is in said door fully locked condition; and latch means for maintaining said access lock in an intermediate door locked condition when said door is returned to closed condition and said access lock is moved from said door unlocked condition towards said door fully locked condition, and said latch means includes means under the control of said mailman for releasing said latch means to permit movement of said access lock from said intermediate door locked condition to said door fully locked condition.

2. A locker according to claim 1, wherein a return mechanism is provided to move said access lock from said door unlocked condition towards said door fully locked condition incident to return of said door to said closed condition.

3. A locker according to claim 2, wherein said return mechanism includes means tending to resiliently maintain said access lock in unlocked condition while said door is in open condition.

4. A locker according to claim 1, wherein said access lock includes a lock bolt pivotally supported for movement between fully locked and unlocked positions, corresponding to said door fully locked and unlocked conditions, respectivly, said lock bolt having a pair of cam ears arranged adjacent a free end thereof and separated by a recess; and said latch means includes a spring biased, pivotally supported locking lever arranged for engagement by said ears incident to pivotal movement of said lock bolt in opposite directions between said door fully locked and unlocked positions, said locking lever permitting movement of said lock bolt from said fully locked position towards said unlocked position while being received within said recess and cooperating with said ears for maintaining said lock bolt in a intermediate locked position corresponding to said intermediate door locked condition when said lock bolt is moved from said unlocked position towards said fully locked position, and said means under the control of said mailman is operative to remove said locking lever from within said recess to permit movement of said lock bolt from said intermediate locked position into said fully locked position.

5. A locker according to claim 4, wherein a return mechanism is provided to move said lock bolt from said unlocked position towards said fully unlocked position incident to return of said door to said closed condition.

6. A locker according to claim 5, wherein said return mechanism includes spring biased means engageable with said lock bolt for releasably maintaining said lock bolt in said unlocked position, while said door is in open condition, and for biasing said lock bolt for movement from said unlocked position towards said fully locked position when said door is returned to said closed condition.

7. A locker according to claim 5, wherein said lock bolt is pivotally supported on said door, said locking lever is pivotally supported by a locker frame bounding an access opening for said storage cabinet normally closed by said door, and said return mechanism includes a lever pivotally supported by said door; a pawl pivotally supported by said lever; and a spring, said lever being arranged for alignment with and removed from alignment with said frame when said door is in said closed and open conditions, respectively, said spring biasing said lever into engagement with said frame to assume a first position when said lever is aligned with said frame and into a second position when said lever is removed from alignment with said frame, said lever engaging with said frame to move said lever from said second position to said first position incident to movement of said door between open and closed conditions, said spring tending to maintain said pawl in a first pivotal position when said lever is in said first position and said lock bolt is in said fully locked position, said lock bolt engaging with said pawl during movement towards said unlocked position to pivot said pawl from said first pivotal position into a second pivotal position against the bias of said spring, said spring tending to pivot said pawl from said second pivotal position into a third pivotal position upon movement of said lever from said first position into said second position, wherein said pawl tends to maintain said lock bolt in said unlocked condition, and said lever upon movement from said second position into said first position returning said pawl to said second pivotal position, wherein said spring exerts a bias in said pawl tending to move said lock bolt from said unlocked position towards said fully locked position.

8. A locker according to claim 1, wherein said access lock is mounted on said door and includes a lock bolt pivotally supported for movement between fully locked and unlocked positions corresponding to said door fully locked and unlocked conditions, said lock bolt when in said fully locked position and an intermediate locked position corresponding to said intermediate door locked condition being arranged for door locking engagement with a locker frame bounding an access opening for said storage cabinet normally closed by said door, and said locker additionally includes a return mechanism for releasably retaining said lock bolt in said unlocked position while said door is in open condition and for moving said lock bolt from said unlocked position to said intermediate locked position incident to return of said door to said closed condition.

9. A locker according to claim 8, wherein said return mechanism includes a housing, a lever, a pawl and a spring, said housing is fixed to a rear surface of said door in surrounding relationship to a portion of said access lock extending rearwardly through said door, said lock bolt is received within said housing when in said unlocked position and has a free end arranged to project from said housing for engagement with said frame during movement of said lock bolt between said intermediate and fully locked positions, said lever has an intermediate portion thereof pivotally supported by said housing, an end portion arranged within said housing and an opposite end portion arranged without said housing and including cam means disposed for aligment with and withdrawal from alignment with said frame when said door is in said closed and open conditions, respectively, said pawl has a mounting end portion pivotally supported by said lever end portion and a latch end portion, said spring biasing said cam means into engagement with said frame to cause said lever to assume a first position when said cam means is aligned with said frame and into a second position when said cam means is withdrawn from alignment with said frame, said cam means engaging with said frame to move said lever from said second position into said first position incident to movement of said door from said open into said closed condition, said spring tending to maintain said pawl in a first pivotal position when said lever is in said first position, wherein said latch end portion engages with one side of said housing, said lock bolt engaging with said latch end portion during movement from said fully locked position into said unlocked position to pivot said pawl from said first pivotal position into a second pivotal position against the bias of said spring, wherein said latch end portion engages with an opposite side of said housing, said spring tending to pivot said pawl from said second pivotal position into a third pivotal position upon movement of said lever from said first position into said second position while said lock bolt remains in said unlocked position, wherein said latch end portion remains in engagement with said opposite side of said housing and engages about said free end of said lock bolt to resiliently retain said lock bolt in said unlocked position, and said lever upon movement from said second position to said first position returning said pawl to said second pivotal position, wherein said spring exerts a bias on said pawl tending to move said lock bolt from said unlocked position into said intermediate locked position.

10. A locker according to claim 9, wherein said lock bolt has a pair of cam ears arranged adjacent said free end and separated by a recess, one of said cam ears leading in the direction of movement of said lock bolt towards said unlocked position is disposed radially outward of the other of said cam ears and substantially overlies said recess, said one of said cam ears engaging with said latch end portion; and said latch means includes a pivotally supported generally L-shaped locking lever biased to normally assume a rest position and arranged to be pivoted in opposite directions from said rest position by engagement with said ears incident to pivotal movement of said lock bolt in opposite directions between said fully locked and unlocked positions, said locking lever permitting movement of said lock bolt from said fully locked position towards said unlocked position while being received within said recess and cooperating with said ears to maintain said lock bolt in said intermediate door locked position when said lock bolt is moved from said unlocked position towards said fully locked position, and said means under the control of said mailman is operative to remove said locking lever from within said recess to permit movement of said lock bolt from said intermediate locked position into said fully locked position.

* * * * *

UNITED STATES PATENT AND TRADEMARK OFFICE

CERTIFICATE OF CORRECTION

PATENT NO. : 4,416,413
DATED : Nov. 22, 1983

INVENTOR(S) : Richard J. Chester

It is certified that error appears in the above-identified patent and that said Letters Patent are hereby corrected as shown below:

Col. 1, Line 65 - "undersirable" should be --- undesirable ---.

Col. 3, Line 10 - "from" should be --- front ---.

Col. 5, Line 52 - "shon" should be --- shown ---.

Col. 7, Line 32 - "and" should be --- end ---.

Col. 7, Line 46 - after "form" please insert "of".

IN THE CLAIMS:

Col. 10, Line 54 - "respectivly" should be --- respectively ---.

Col. 10, Line 64 - "a" should be --- an ---.

Col. 12, Line 9 - "aligment" should be --- alignment ---.

Signed and Sealed this

*Fourteenth* Day of *February 1984*

[SEAL]

*Attest:*

GERALD J. MOSSINGHOFF

*Attesting Officer*

*Commissioner of Patents and Trademarks*